United States Patent [19]

Yamauchi

[11] 3,980,918

[45] Sept. 14, 1976

[54] ELECTRON GUN ASSEMBLY FOR COLOR PICTURE TUBE

[75] Inventor: Masaaki Yamauchi, Mobara, Japan

[73] Assignee: Hitachi, Ltd., Japan

[22] Filed: Mar. 11, 1974

[21] Appl. No.: 450,188

[30] Foreign Application Priority Data

Oct. 5, 1973 Japan ..... 48-111447

[52] U.S. Cl. ..... 313/417

[51] Int. Cl.[2] ..... H01J 29/46; H01J 29/51

[58] Field of Search ..... 313/409, 414, 417

[56] References Cited

UNITED STATES PATENTS 3,604,973 9/1971 Doggett et al. ..... 313/417 X

*Primary Examiner*—Robert Segal

*Attorney, Agent, or Firm*—Craig & Antonelli

[57] ABSTRACT

An electron gun assembly for a color picture tube is disclosed which comprises three electron guns juxtaposed in the same plane and a pole piece cup arranged on the final-electrode side of the electron guns; wherein only the final electrode of the electron gun at the center is fixed on the pole piece cup.

7 Claims, 7 Drawing Figures

ELECTRON GUN ASSEMBLY FOR COLOR PICTURE TUBE

The present invention relates to an electron gun assembly for a color picture tube or more in particular to the electron gun assembly of in-line type.

Prior art and the present invention and the advantage of the latter will be described in detail with reference to the accompanying drawings, in which.

Figure 1:
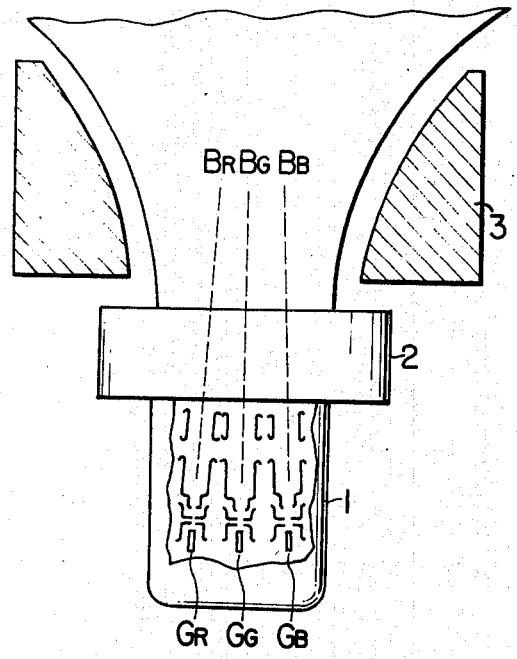
FIG. 1 is a schematic diagram showing the neck portion of a prior art color picture tube on which the electron gun assembly of in-line type is mounted.

Generally, the electron gun assembly of inline type for the color picture tube comprises three electron guns $G_R$, $G_G$ and $G_B$ contained in the neck 1 of the color picture tube and arranged in the same plane as shown in FIG. 1. Each of the three electron guns $G_R$, $G_G$ and $G_B$ comprises a plurality of electrodes held by supports fixed on bead glass members, so that the paths of electron beams $B_R$, $B_G$ and $B_B$ emitted from the electron guns $G_R$, $G_G$ and $G_B$ respectively are appropriately corrected by a convergence adjuster 2 and deflected by deflection yoke 3 thereby to scan a phosphor screen not shown.

Figure 2:
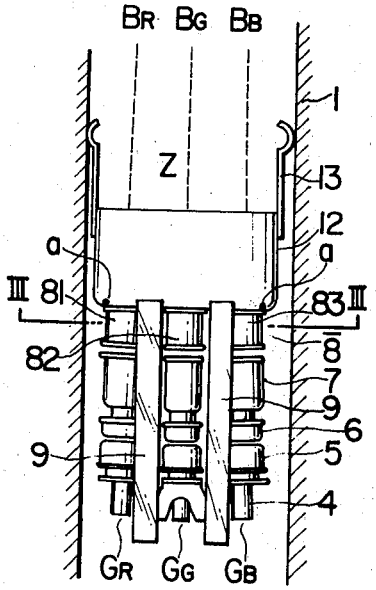
FIG. 2 is a diagram schematically showing a conventional electron gun assembly of in-line type.
Figure 3:
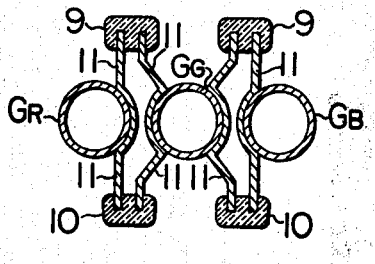
FIG. 3 shows a sectional view taken in line III—III of FIG. 2.

Referring to FIG. 2 showing the detailed construction of the above-mentioned electron gun assembly for the color picture tube, reference numeral 4 shows cathodes and, numerals 5, 6, 7 and 8 grid electrodes. All of these electrodes are supported by supports 11 fixed on the bead glass members 9 and 10, as shown in FIG. 3, thus making up the aforementioned electron guns $G_R$, $G_G$ and $G_B$. The grid electrodes 8, because of their positions nearest to the phosphor screen of all the electrodes of the electron guns, will hereinafter be referred to as the "final electrodes", the final electrodes for the electron guns $G_R$, $G_G$ and $G_B$ being shown by numerals 81, 82 and 83 respectively. The final electrodes 81, 82 and 83 are fixed on the pole piece cup by means of a spot welder. The final electrodes 81 and 83 on both sides with the ends *a* fixed on the pole piece cup 12 are tilted at a certain angle with the tube axis Z. The pole piece cup 12 is supported by a bulb spacer contact 13 pressed against the neck 1. The above-described component elements provides an arrangement for emitting the electron beams $B_R$, $B_G$ and $B_B$.

Figure 4:
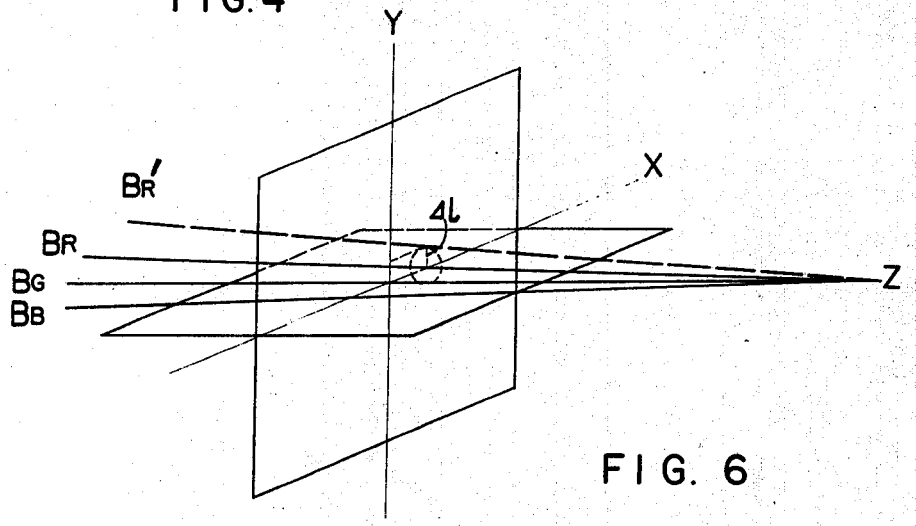
FIG. 4 is a diagram for explaining the convergence of the three electron beams emitted from the electron gun assembly of in-line type.

It is a well known fact that if proper dynamic convergence of the electron beams is to be achieved, the central electron beam $B_G$ is required to run accurately along the central axis of the deflection yoke 3 on one hand while the three electron beams must be in the same plane as the electron beams $B_R$ and $B_B$ tilted toward the central electron beam $B_G$ in an equiangular manner. In other words, assuming that in FIG. 4 a hypothetical Z axis coinciding with the central axis of the deflection yoke 3 intersects hypothetical X and Y axes at right angles while the X axis in the plane including the paths of the three beams is perpendicular to vertical Y axis in the central deflection area, the central electron beam $B_G$ runs exactly along the Z axis as mentioned earlier whereas the electron beams $B_B$ and $B_R$ on both sides thereof must run in the plane including the X and Z axes and at the same time tilt toward the central beam $B_G$ symmectrically with respect thereto. Assume again that the electron beam $B_R$ is displaced vertically by $\Delta l$ as shown by $B_R'$ in the plane including X and Y axes. Even if proper convergence is achieved in the middle area of the phosphor screen, such a proper convergence cannot be achieved at the peripheral areas thereof. This is because, in the case of this system in which the deflection yoke is made with a high accuracy so as to obtain a sufficiently symmetrical magnetic field, the in-line type electron gun assembly is assembled with a high accuracy, and the dynamic convergence can be made simple or omitted by the combination of such deflection yoke and electron gun assembly, these required accuracies are not satisfied. The results of our experiments show that it is impossible to achieve a required convergence if the amount of displacement $\Delta l$ is 0.1 mm or more.

The above-mentioned displacement is considered to be attributable to the following fact: In the already-mentioned arrangement of the electron gun assembly where as shown in FIG. 2 the electron guns $G_R$ and $G_B$ on both sides tilted toward each other and supported on the supports 11 are provided with the ends *a* of the final electrodes 81 and 83 fixed on the pole piece cup at a certain angle, the fixing of the ends *a* to the pole piece cup 12 requires a considerable amount of pressure to be undesirably applied to the final electrodes 81 and 83, resulting in the noted displacement thereof. Under this condition, the electron guns actuated emit the electron beams $B_R$ and $B_B$ so displaced that it is impossible to attain the required convergence.

Accordingly, it is an object of the present invention to provide an electron gun assembly for the color picture tube which is capable of attaining a high accuracy of convergence of the electron beams on the phosphor screen.

According to the present invention, there is provided an electron gun assembly for the color picture tube comprising three electron guns each including a plurality of electrodes and juxtaposed in the same plane, a plurality of supports for supporting the electron guns and a pole piece cup arranged on the final-electrode side of the electron guns; wherein only the final electrode of the central electron gun among the three electron guns is fixed on the pole piece cup.

An embodiment of the present invention will be explained below with reference to FIGS. 5 to 7.

Figure 5:
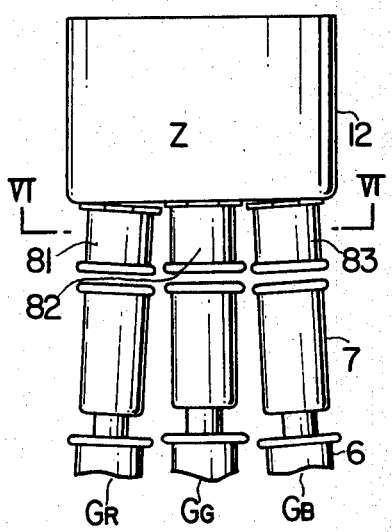
FIG. 5 is a schematic diagram showing an electron gun assembly for the color picture tube according to an embodiment of the present invention.
Figure 6:
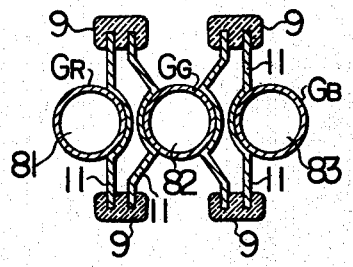
FIG. 6 is a diagram showing a sectional view taken in line VI—VI of FIG. 5.
Figure 7:
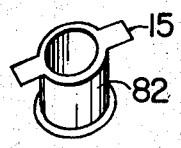
FIG. 7 is a schematic diagram showing the final electrode used with the central electron gun of the electron gun assembly shown in FIG. 5.

In FIG. 5 showing the electron gun assembly according to an embodiment of the invention, the same component elements as those in FIG. 2 are shown by the same reference numerals, FIG. 6 showing a sectional view taken in line VI—VI in FIG. 5. In the drawings, the final electrodes 81, 82 and 83 have their central axes superposed on those of the grid electrodes 6 and 7 and appropriately tilted to each other. The final electrode 82 of the central electron gun $G_G$ has a flange 15 as shown in FIG. 7 which is fixedly welded to the pole piece cup 3 by means of a spot welder, with the result that the final electrode 82 is fixed into position on the central axis of the pole piece cup coinciding with the axis of the deflection yoke, that is, Z axis. The final electrodes 81 and 83 of the electron guns $G_R$ and $G_B$ on both sides of the electron gun $G_G$, by contrast, are held only by the supports 11 without being fixed on the pole piece cup. In this way, it is possible to eliminate the problem of displacement of the final electrodes 81 and 83 and hence that of the electron beams $B_R$ and $B_B$ which occurs when they are fixed on the pole piece cup as in the conventional electron gun assembly.

It will be understood from the foregoing description that according to the present invention only the final electrode of the central electron gun of the electron gun assembly of the color picture tube is fixed onto the pole piece cup whereas the other final electrodes are not fixed on it, resulting in the advantage that no displacement of the final electrodes occurs in the manufacturing processes for the electron guns, thereby enabling a required dynamic convergence to be achieved.

What is claimed is:

1. An electron gun assembly for the color picture tube comprising three electron guns each including a plurality of electrodes and juxtaposed in the same plane, a plurality of supports for supporting said electron guns, and a pole piece cup arranged on the final-electrode side of said electron guns; wherein only the final electrode of the central electrode gun among said three electron guns is fixed on said pole piece cup.

2. In an electron gun assembly for a color picture tube with a neck portion comprising three electron guns arranged in the same plane within the neck portion, each electron gun including a plurality of electrodes aligned along a common axis and supported by a plurality of support members, and a pole piece cup for applying a convergence force to electron beams emitted from the electron guns and traveling through the electrodes, said pole piece cup arranged so the final-electrode side of the electron guns within the neck portion, the improvement wherein only the final electrode of the central electron gun among said three electron guns is fixed to said pole piece cup.

3. An electron gun assembly according to claim 1, wherein said final electrode of the central electron gun has a flange adapted for fixing said final electrode to said pole piece cup.

4. In an electron gun assembly for a color picture tube having a neck portion comprising an electron gun arrangement including a plurality of electron guns, the axes of which are coplanar, said electron guns being mechanically interconnected, and means for applying a convergence force to the electron beams emitted from said electron guns, the improvement wherein only one of said electron guns is directly mechanically attached to said convergence force applying means.

5. The improvement according to claim 4, wherein each of said electron guns includes a plurality of electrodes disposed along the axis thereof, and wherein said only one of said electron guns is directly mechanically attached to said convergence force applying means by way of that electrode which is nearest to said convergence force applying means.

6. The improvement according to claim 5, wherein said nearest electrode has a flange attaching said nearest electrode to said convergence force applying means.

7. The improvement according to claim 5, wherein said plurality of electron guns is made up of three electron guns and wherein said only one of said electron guns is the central gun among said three electron guns.

* * * * *